US008191477B1

(12) United States Patent
Roesler

(10) Patent No.: US 8,191,477 B1
(45) Date of Patent: Jun. 5, 2012

(54) MICROELECTROMECHANICAL SAFE ARM DEVICE

(75) Inventor: Alexander W. Roesler, Tijeras, NM (US)

(73) Assignee: Sandia Corporation, Albuquerque, NM (US)

( * ) Notice: Subject to any disclaimer, the term of this patent is extended or adjusted under 35 U.S.C. 154(b) by 1937 days.

(21) Appl. No.: 11/305,258

(22) Filed: Dec. 15, 2005

(51) Int. Cl.
*F42C 15/184* (2006.01)
*F42C 15/40* (2006.01)

(52) U.S. Cl. ..... 102/254; 102/222

(58) Field of Classification Search ..... 102/221, 102/222, 226, 235, 244, 251, 254
See application file for complete search history.

(56) References Cited

U.S. PATENT DOCUMENTS

| | | | | |
|---|---|---|---|---|
| 3,765,332 | A | 10/1973 | Baker | |
| 4,240,351 | A | 12/1980 | San Miguel | |
| 4,854,239 | A | 8/1989 | Van Sloun | |
| 5,063,846 | A | 11/1991 | Willis et al. | |
| 6,167,809 | B1 * | 1/2001 | Robinson et al. | 102/235 |
| 6,295,932 | B1 | 10/2001 | Kane, III | |
| 6,374,739 | B1 * | 4/2002 | Smith et al. | 102/221 |
| 6,439,119 | B1 * | 8/2002 | Smith et al. | 102/221 |
| 6,964,231 | B1 * | 11/2005 | Robinson et al. | 102/235 |
| 7,051,656 | B1 * | 5/2006 | Koehler et al. | 102/249 |
| 7,142,087 | B2 * | 11/2006 | Greywall | 337/36 |
| 2005/0183609 | A1 * | 8/2005 | Greywall | 102/247 |

FOREIGN PATENT DOCUMENTS

WO WO 2004/111568 A2 12/2004

OTHER PUBLICATIONS

Randall D. Cope, "NAVAIR Fuze Overview", Presented at the NDIA 48th Annual Fuze Conference, Apr. 26-27, 2004, Charlotte, NC, USA.

Wai-Chuen Gan et al., "Development and Control of a Low-Cost Linear Variable-Reluctance Motor for Precision Manufacturing Automation", IEEE/ASME Transactions on Mechatronics, vol. 8, No. 3, pp. 326-333, Sep. 2003.

Chris Bang, "EFAB, A New Approach to MEMS Fabrication" Sensors Magazine Online, Nov. 2002, [online] [retrieved on Dec. 7, 2005] retrieved from the Internet: <URL:http://www.sensorsmag.com/articles/1102/14/main.shtml>.

Microfabrica, Inc, "EFAB™ Comparison", [online] [retrieved on Dec. 7, 2005] retrieved from the Internet: <URL:http://www.microfabrica.com/efab/EFAB_comparison.htm>.

M. Fohse et al., "Thinfilm Technologies to Fabricate a Linear Microactuator", Sensors and Actuators A 91 (2001) pp. 145-149.

E.J. O'Sullivan et al., "Integrated, Variable-Reluctance Magnetic Minimotor", IBM J. Res. Develop. vol. 42, No. 5, Sep. 1998.

* cited by examiner

*Primary Examiner* — Bret Hayes
(74) *Attorney, Agent, or Firm* — Olivia J. Tsai

(57) ABSTRACT

Microelectromechanical (MEM) apparatus and methods for operating, for preventing unintentional detonation of energetic components comprising pyrotechnic and explosive materials, such as air bag deployment systems, munitions and pyrotechnics. The MEM apparatus comprises an interrupting member that can be moved to block (interrupt) or complete (uninterrupt) an explosive train that is part of an energetic component. One or more latching members are provided that engage and prevent the movement of the interrupting member, until the one or more latching members are disengaged from the interrupting member. The MEM apparatus can be utilized as a safe and arm device (SAD) and electronic safe and arm device (ESAD) in preventing unintentional detonations. Methods for operating the MEM apparatus include independently applying drive signals to the actuators coupled to the latching members, and an actuator coupled to the interrupting member.

24 Claims, 9 Drawing Sheets

MICROELECTROMECHANICAL SAFE ARM DEVICE

STATEMENT REGARDING FEDERALLY SPONSORED RESEARCH OR DEVELOPMENT

The United States Government has certain rights in this invention pursuant to Department of Energy Contract No. DE-AC04-94AL85000 with Sandia Corporation.

FIELD OF THE INVENTION

The present invention relates to microelectromechanical (MEM) safing and arming devices as may be utilized in energetic components comprising pyrotechnic and explosive materials. The present invention additionally relates to MEM devices that can function to prevent an un-intentional operation of a energetic component by blocking an explosive train and, can function to allow an intentional operation of an energetic component, by completing an explosive train.

BRIEF DESCRIPTION OF THE DRAWINGS

The accompanying drawings, which are incorporated in and form part of the specification, illustrate several embodiments of the present invention and, together with the description, serve to explain the principles of the invention. The drawings provided herein are not drawn to scale.

DETAILED DESCRIPTION OF THE INVENTION

Figure 1A:
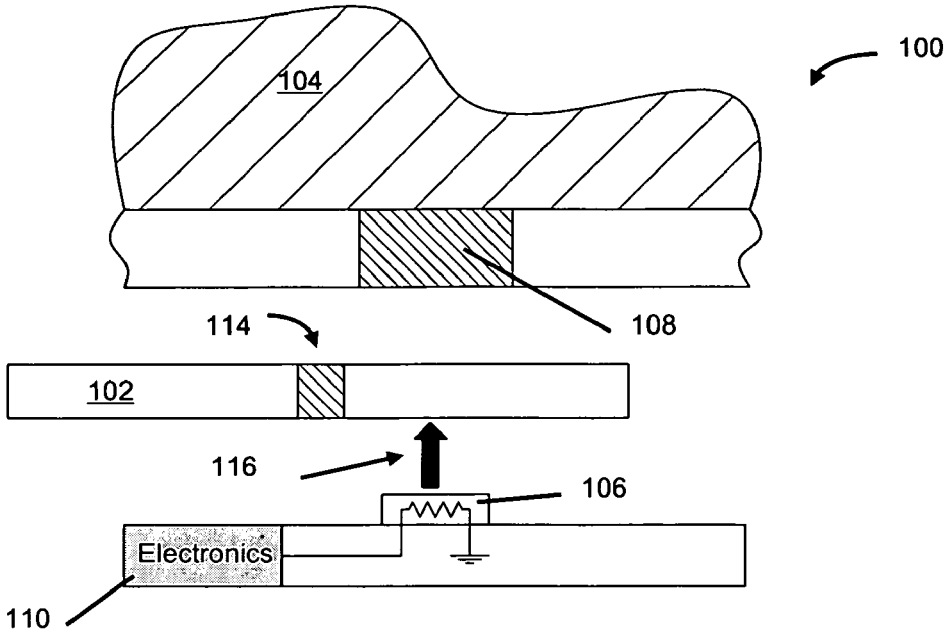
FIGS. 1A and 1B are schematic illustrations of an exemplary explosive train.

Microelectromechanical (MEM) safing and arming (safe and arm) devices may be utilized in energetic components comprising pyrotechnic and explosive materials. MEM safing and arming devices can function to prevent an un-intentional operation of a energetic component by blocking an explosive train and, can function to allow an intentional operation of an energetic component, by completing an explosive train. Energetic components that can utilize MEM safing and arming devices can be found in air bag deployment systems, initiators for rocket propellants and boosters, munitions and pyrotechnics. The following prophetic examples serve to illustrate the methods and apparatus according to the present invention.

Microelectromechanical (MEM) fabrication technologies including surface micromachining, methods based on integrated circuit (IC) manufacturing, e.g. semiconductor device manufacture, bulk micromachining, focused ion beam (FIB) processing, LIGA (an acronym based on the first letters for the German words for lithography, electroplating and molding) and combinations thereof, can be used to form microsystems, microsensors and microactuators. These MEM fabrication technologies can provide for batch fabrication of multiple devices, that are fully assembled as-fabricated, requiring little to no post fabrication assembly. Dimensions of structures fabricated by MEM technologies can range from on the order of 0.1 μm, to on the order of a few millimeters, and include silicon, polysilicon, glass, dielectric and metallic structures that are either unsupported (i.e. free standing) or alternatively can be adhered to a substrate, or built up upon a substrate during manufacture. Substrates can comprise ceramics, glass-ceramics, low-temperature co-fireable ceramics (LTCC), quartz, glass, a printed wiring board (e.g. manufactured of polymeric materials including polytetrafluoroethylene, polyimide, epoxy, glass filled epoxy), silicon (e.g. silicon wafers) and metals. Dielectric layers for example, polymeric, silicon-oxide, silicon-nitride, glass and ceramic layers can be applied to the surface of conductive substrates (e.g. metallic and silicon substrates) to electrically isolate individual MEM structures or MEM elements within a structure. Embodiments of the present invention fabricated in MEM technologies, can comprise safe and arm devices that are highly integrated and compact, and are readily insertable into the explosive train of energetic components.

In the context of the present disclosure, MEM devices are defined to be those devices manufactured using one or more of the MEM fabrication technologies described above, and having dimensions ranging from on the order of 0.1 μm, to on the order of a few millimeters. An explosive train is defined herein as a succession of one or more initiating, igniting, detonating, and explosive (e.g. booster) charges, arranged to cause an energetic material within the explosive train, to combust, explode, and spontaneously release energy. Elements within an explosive train can include: electrically heated wires, spark gaps, bridge wires, silicon bridgewires (SCBs), reactive initiators (e.g. a layer structure of exothermically reacting materials such as aluminum and palladium, and titanium and boron), slappers (e.g. exploding foil initiators), chip slappers, detonators, explosive charges and other energetic materials (i.e. pyrotechnics and fuels). Energetic components include components and devices that comprise energetic materials such as explosives, propellants, fuels, gas generating materials, combustibles, unstable and metastable materials. The energetic materials within an energetic component can be arranged in an explosive train. The path of an energetic train is defined herein to be path of energy transfer from one element within the explosive train, to another element within the explosive train.

FIG. 1A illustrates an exemplary explosive train 100 as can be found in an energetic component. The explosive train 100 is shown in a safe state, with a movable interrupter 102 positioned in an interrupting state (i.e. interrupted state). In this example, a primary charge 104, such as a gas generating material for deploying airbags, is aligned with a booster charge 108 and an initiator 106, such as a slapper or reactive bridgewire. In the interrupting state, the interrupting member 102 serves to block the transfer of energy 116 from the initiator 106 to the booster 108. In the interrupting state, should the initiator 106 be energized, for example by inadvertent activation of electronics 110, insufficient energy is transferred from the initiator 106 to the booster 108 to cause the booster 108 to ignite (i.e. ignite, burn, deflagrate or detonate) thereby preventing ignition (i.e. ignition, burning, deflagration or detonation) of the primary charge 104. In the interrupting state, the explosive train 100 can be said to be safe and "out of line".

Figure 1B:
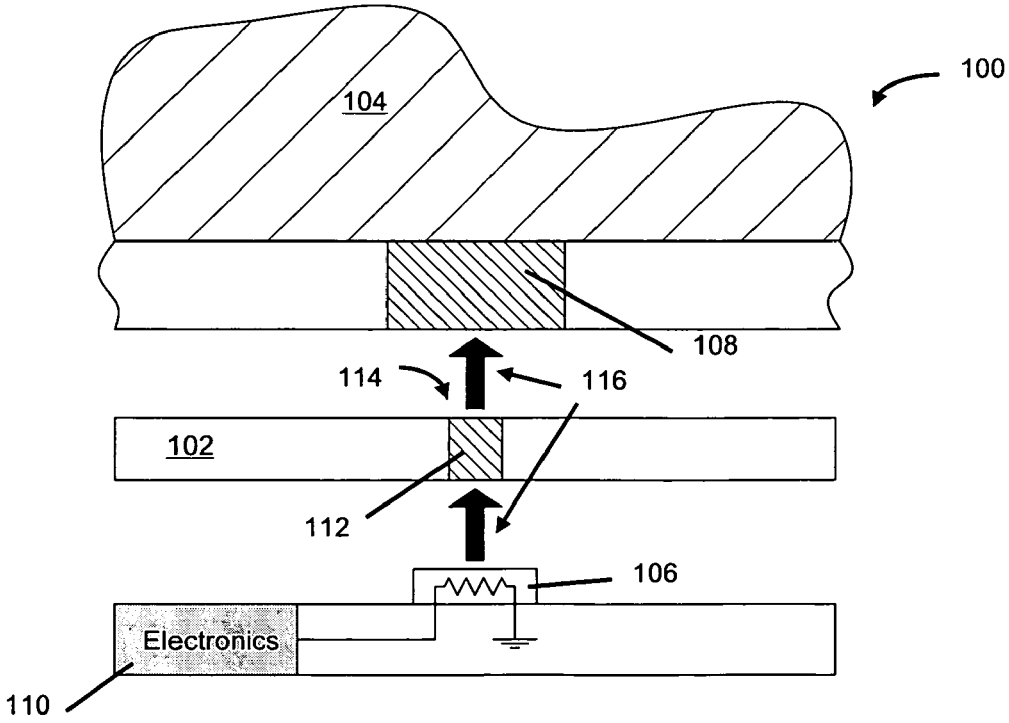

FIG. 1B illustrates the exemplary explosive train 100 in an armed state, wherein the interrupter 102 has been moved into a non-interrupting state (i.e. uninterrupted state). Interrupter 102 can contain an aperture 114 (e.g. a through-hole), that is sufficiently aligned with the explosive train comprising the primary charge 104, booster 108 and initiator 106, such that when the initiator 106 is energized, sufficient energy 116 is transferred from the initiator 106 through the aperture 114, to the booster 108 causing the booster 108 to ignite, and thereby igniting the primary charge 104. In the non-interrupting state, the explosive train 100 can be said to be armed and "in line".

In embodiments of the invention, the aperture 114 can contain a charge of energetic material 112, e.g. a pellet of explosive material (for example, silver azide, lead azide, copper azide, and lead styphnate) that can be placed in alignment with the explosive train (i.e. when the interrupter 102 is in the non-interrupting state) for transferring energy from the initiator 106 to the booster 108. In other embodiments of the invention, the interrupter can be arranged to move other elements that may comprise an explosive train, either into or out of line. The interrupter 102 can be formed of an elongated member operated by a linear drive mechanism, or alternatively can be provided in the form of a paddle, shuttle, or shutter in linearly or rotatably actuated arrangements.

Figure 2A:
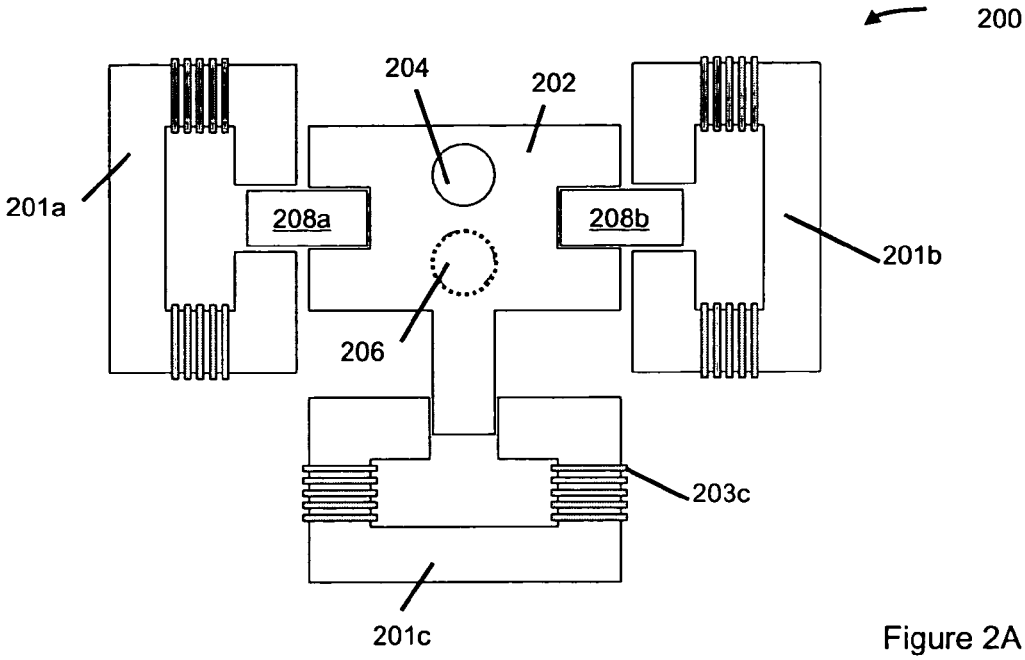
FIGS. 2A-2D are schematic illustrations of an embodiment of the invention.

FIGS. 2A-2D are schematic illustrations of an embodiment of a MEM safing and arming device 200, according to the present invention. In FIG. 2A, MEM device 200 can comprise a movable interrupter 202 having an aperture 204 disposed therethrough. In the safe condition as shown, the aperture 204 is out of line with the energetic path of an explosive train, designated as 206. An actuator 201*c*, illustrated as an electric solenoid having windings 203*c*, is magnetically coupled to the interrupter 202, for moving the interrupter 202 to cause the aperture 204 to be substantially aligned, or non-aligned, to the path of the explosive train 206 (i.e. place the interrupter in the un-interrupted state or the interrupted state). Additional actuators 201*a* and 201*b* (illustrated as electrical solenoids) can be provided for moving latches 208*a* and 208*b* respectively, into engagement and disengagement with the interrupter 202. In FIG. 2A the latches 208*a* and 208*b* are engaged with the interrupter 202. Engagement of either or both of the latches 208*a* and 208*b*, prevents the interrupter from moving in a manner that would allow the interrupter to change state. In this example, the interrupter can be latched into a safe, interrupted state, until a user directed control signal, is applied to actuators 201*a-b* to disengage the latches from the interrupter.

Figure 2B:
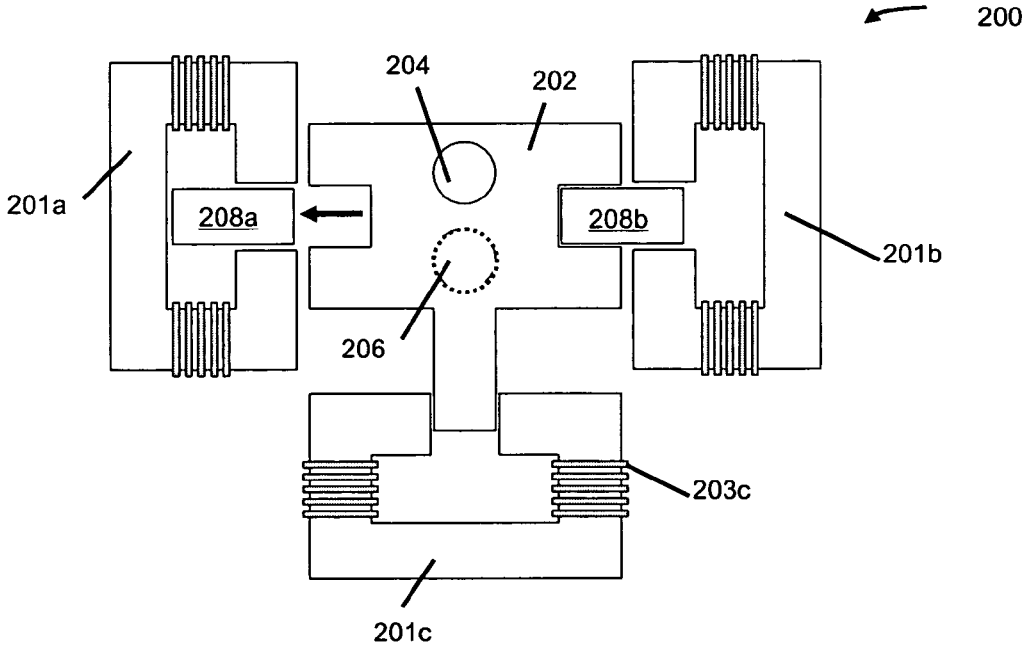

In FIG. 2B, a drive signal has been applied to actuator 201*a*, causing latch 208*a* to be disengaged from interrupter 202.

Figure 2C:
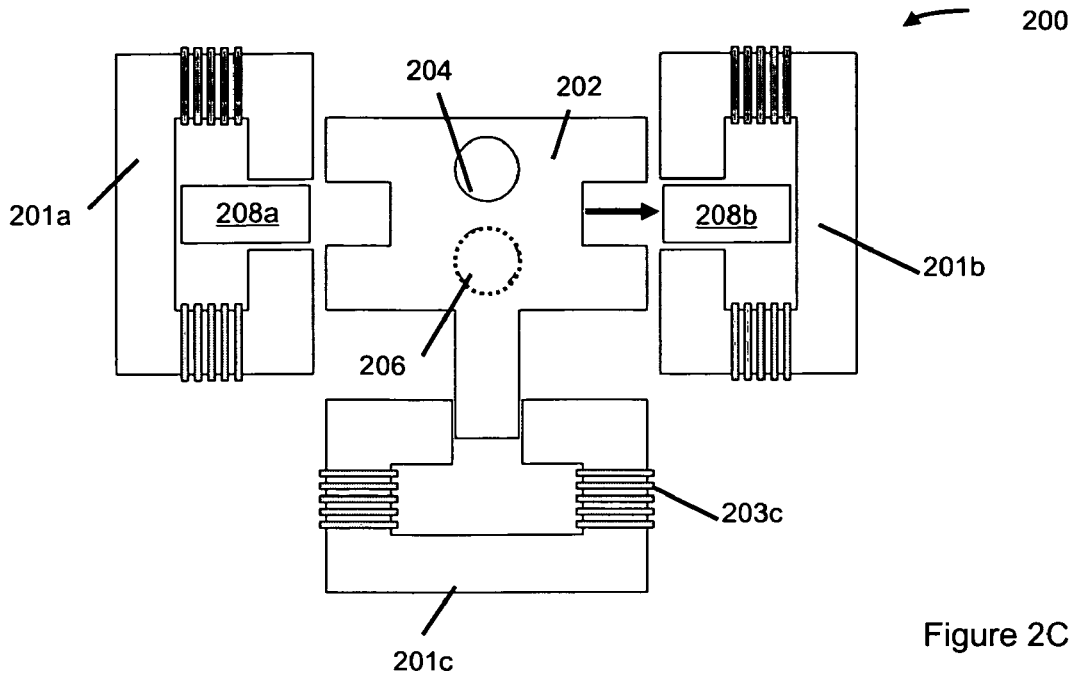

In FIG. 2C, a drive signal has been applied to actuator 201*b*, causing latch 208*b* to be disengaged from interrupter 202.

Figure 2D:
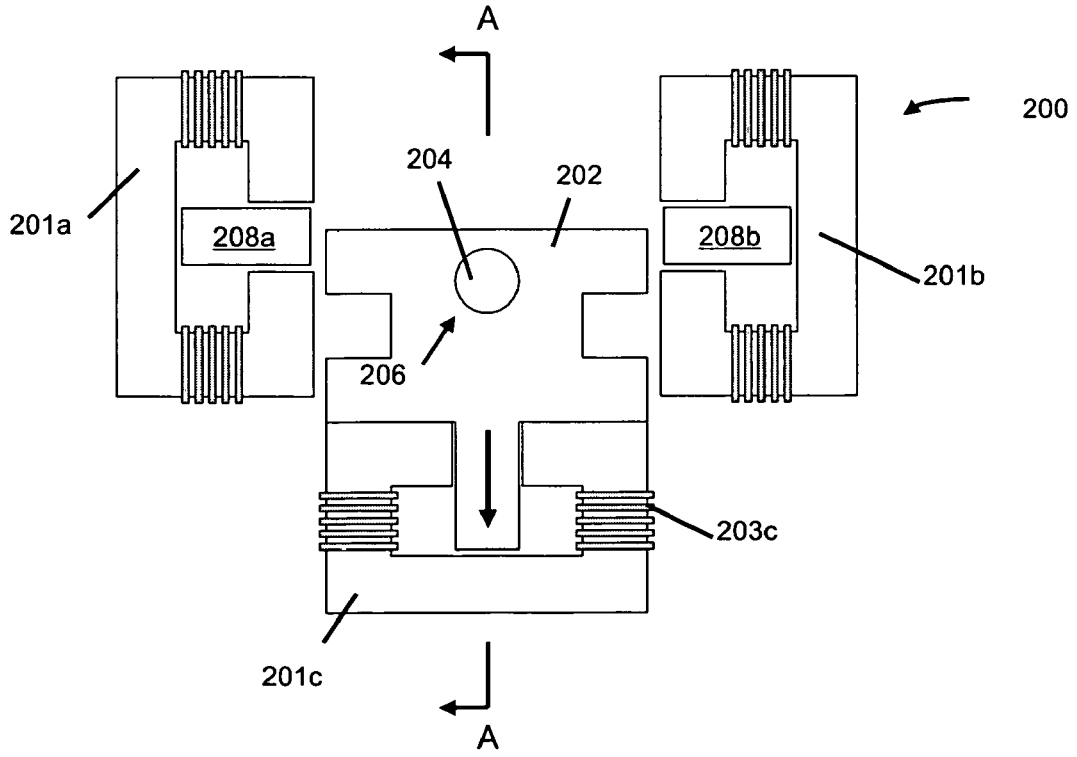

In FIG. 2D, a drive signal has been applied to actuator 201*c*, causing the interrupter 202 to move, changing the state of the interrupter from interrupted to non-interrupted, whereby the aperture 204 is substantially aligned with the explosive train 206.

In the embodiment of the invention illustrated in FIGS. 2A-2D, three drive signals are required to change the state of the interrupter 202, a separate drive signal for each actuator 201*a-c*. It will be apparent to the reader of the instant disclosure, that a minimum of one drive signal, would be required to actuate the MEM device 200 and that the use of more than one drive signal (and multiple actuators and latches) provides additional levels of protection against an unintentional or inadvertent ignition of an energetic component comprising the explosive train 206.

The actuators 201*a-c* can comprise linear and rotary actuators fabricated in MEM technologies including electrostatic, electromagnetic, piezoelectric, magnetostrictive and thermal actuators, that can be actuated through the application of electrical, magnetic, thermal and optical signals as inputs to the device. MEM device 200 can be fabricated on a substrate (not shown) providing mechanical support for the actuators, interrupter and latches, including slideable supports as rails and guides (not shown). Embodiments of the interrupter 202 can be arranged to align an aperture 204 to an explosive train 206 including a clearance hole through a substrate, or an interrupter can be arranged to extend beyond the perimeter of a substrate to operate upon an explosive train, for example, that is adjacent to the substrate. As described above, embodiments can make use of an interrupter having an aperture that contains an energetic material, or that operates to move one or more elements of an explosive train, into and out of line.

The drive signals applied to the actuators 201*a-c* can comprise alternating current (AC) and direct current (DC) electrical signals. In the embodiment illustrated in FIGS. 2A-D, the electrical signals are applied to the actuators 201*a-c* in a particular sequence to allow the user to change the state of the interrupter 202. For example, drive signals must be applied to actuators 201*a-b*, to place latches 208*a-b* in the disengaged state, prior to applying a drive signal to actuator 201*c*, to allow movement of the interrupter 202. Applying a drive signal to actuator 201*c* prior to applying a drive signal to actuators 201*a-b* (and disengaging the latches) will not result in changing the state of the interrupter 202. Additional variations for the actuators and drive signals are discussed below.

Embodiments of the MEM safe arm device 200, for example fabricated by a MEM technology wherein a plurality of metallic layers are sequentially deposited upon the surface of a substrate and patterned, can comprise a series of stacked layers of soft magnetic materials (for example nickel, iron, alloys of nickel and iron, and alloys of nickel and iron including cobalt, silicon, manganese and molybdenum). Individual layers can be electro-deposited and patterned on top of a preceding layer, to define a desired mechanical structure. Sacrificial materials, materials that are ultimately removed in the manufacturing process, can be incorporated into the layered stack-up to define eventual spacings, clearances and gaps between elements comprising the mechanical structure. Suitable substrates include ceramics, glass-ceramics, quartz, glass, polymeric materials (e.g. printed wiring board materials), silicon (e.g. silicon wafers) and metals. Dielectric layers for example, polymeric, silicon-oxide, silicon-nitride, glass and ceramic layers can be applied to the surface of conductive substrates (e.g. metallic and silicon substrates) to electrically isolate individual MEM structures or MEM elements within a structure. In embodiments fabricated using electrodeposition processes, a layer (e.g. a seed layer) comprising an electrically conductive material can be deposited upon a surface of a non-conducting substrate, allowing for patterning and electro-deposition of subsequent layers. The seed layer can be removed (e.g. by etching) during the fabrication process to provide for electrical isolation of the various elements of the MEM device 200. Use of highly conductive metallic layers (e.g. copper, silver and gold) can be incorporated into MEM fabrication technologies to produce electrical conductors such as coils 203*c*. Metals such as nickel, copper, iron, boron, chromium, titanium, samarium, neodymium, manganese, lanthanum, calcium, tungsten and aluminum (and alloys thereof) can be incorporated into the fabrication process to tailor the electrical and magnetic performance of the MEM structures. For example using a nickel-iron alloy to form the armature of an actuator, for example 201*c*, and using copper to form the coils of the actuator.

Figure 2E:
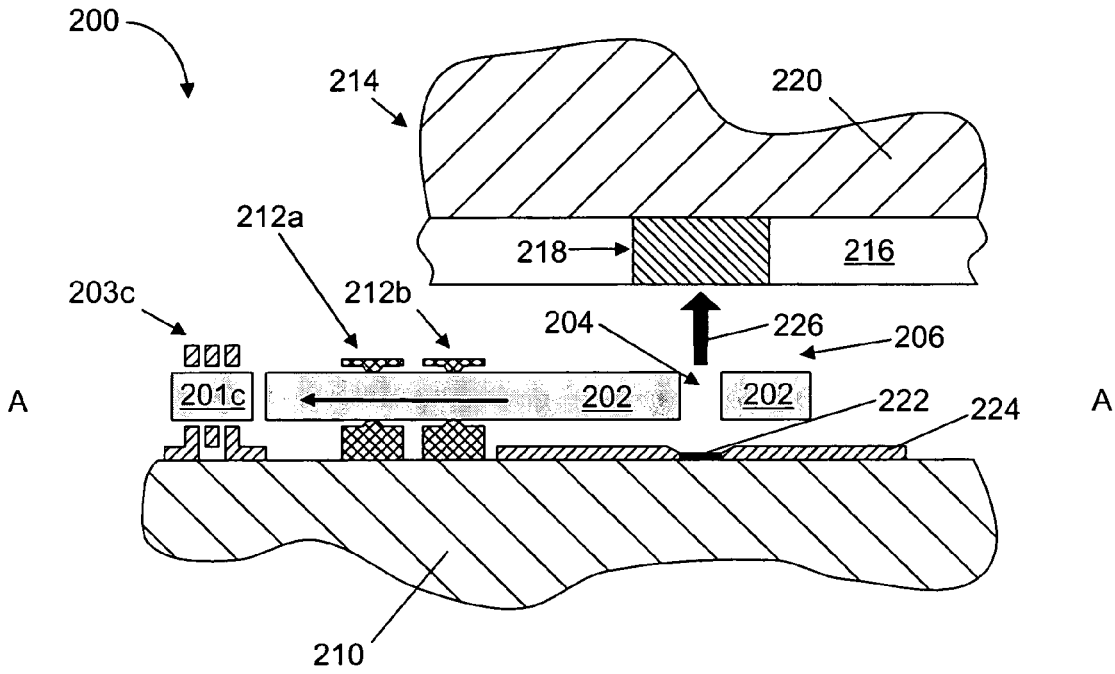
FIG. 2E is a cross-sectional view of the embodiment in FIG. 2D.

FIG. 2E is a cross sectional schematic illustration of the embodiment of the MEM safing and arming device 200, as viewed along the section line A-A in FIG. 2D. In this exemplary embodiment, interrupter 202 is coupled to actuator 201*c* and slideably anchored to substrate 210 by guides 212*a-b*. An initiator 222 is disposed on the surface of substrate 210. In this example, initiator 222 is illustrated as a slapper or exploding foil device having electrical leads 224, and can be fabricated using MEM technologies, as used in making the MEM safing and arming device 200. Initiator 222 can comprise a variety of initiating and detonating devices, as described above. Energetic component 214 can comprise the shell or wall 216 of a housing for the booster charge 218 and primary charge 220. With the interrupter 202 positioned in the non-interrupting state as shown, aperture 204 is in-line with explosive train 206 and, energy 226 can flow from the initiator 222, through aperture 204 and impinge upon and ignite the booster charge 218, therefore transferring sufficient energy to ignite the primary charge 220.

FIGS. 3A through 3D are schematic illustrations of another embodiment of a MEM safe arm device 300 as can be fabricated according to the present invention. MEM device 300 comprises an interrupter 302 having an aperture 304, coupled to the traveler 316 of a linear variable reluctance motor 306. Latching pins 308*a-b* are coupled to solenoid actuators 310*a-b* which additionally comprise springs 312*a-b*. Latching pins 308*a-b* are illustrated as engaged with the interrupter 302 thereby preventing the interrupter 302 from changing state.

Figure 3A:
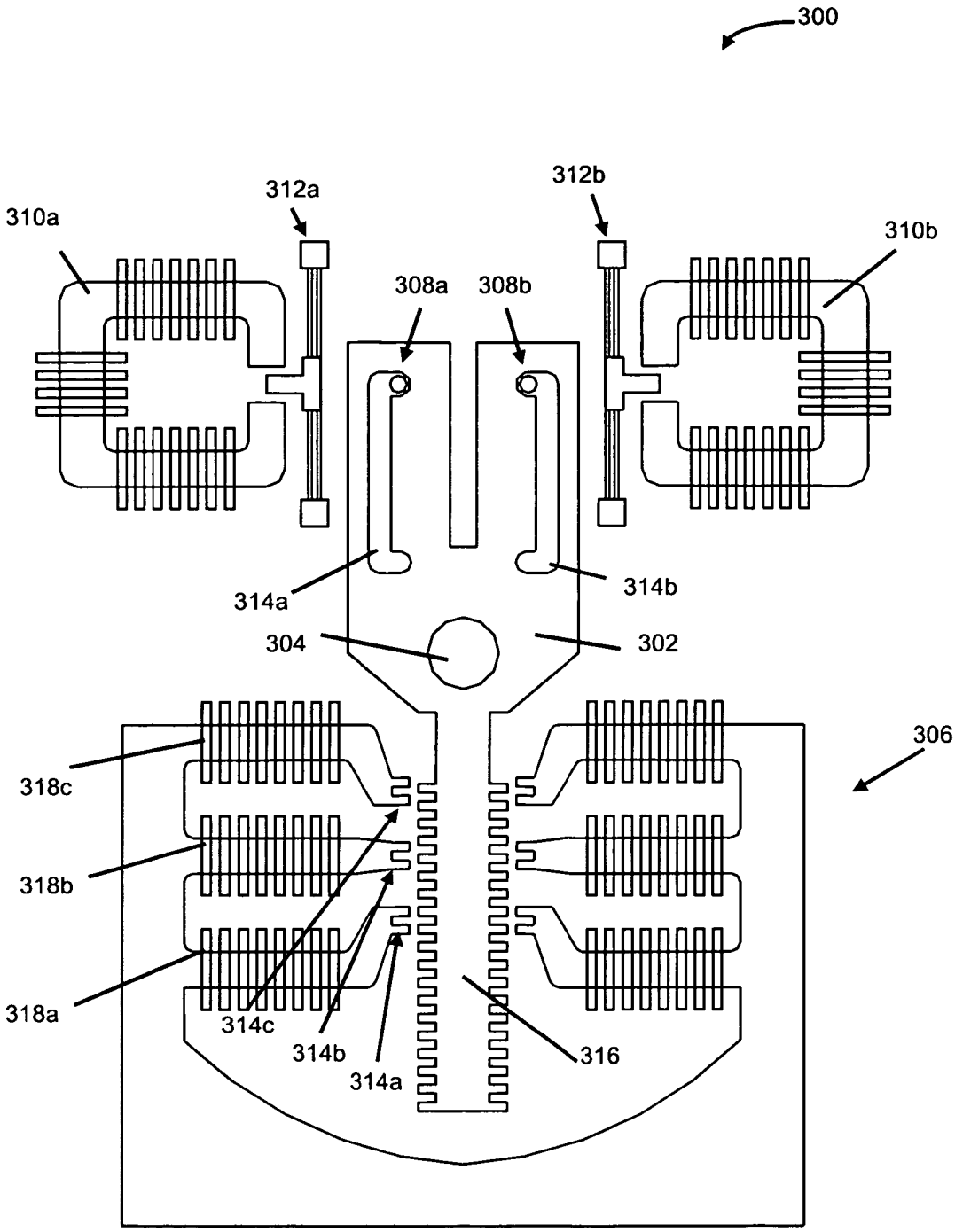
FIG. 3A-3D is a schematic illustration of another embodiment of the invention.
Figure 3B:
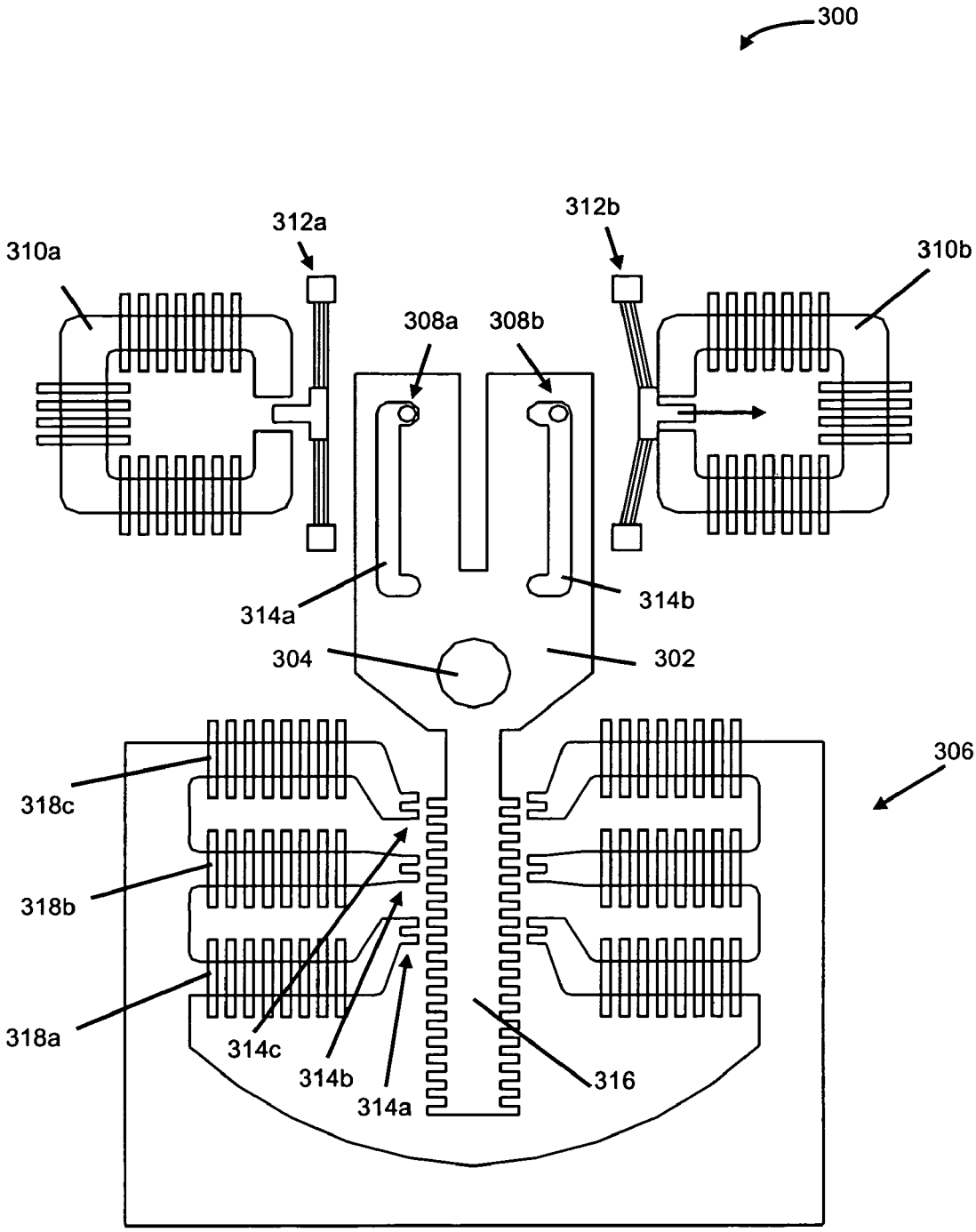

In FIG. 3B, a drive signal has been applied to actuator 310*b*, causing latching pin 308*b* to be disengaged from the interrupter 302, and into alignment with guide 314*b*. Activating the actuator 310*b* has caused the spring 312*b* to be loaded, such that removal of the drive signal would cause the latching pin 308*b* to re-engage the interrupter 302.

Figure 3C:
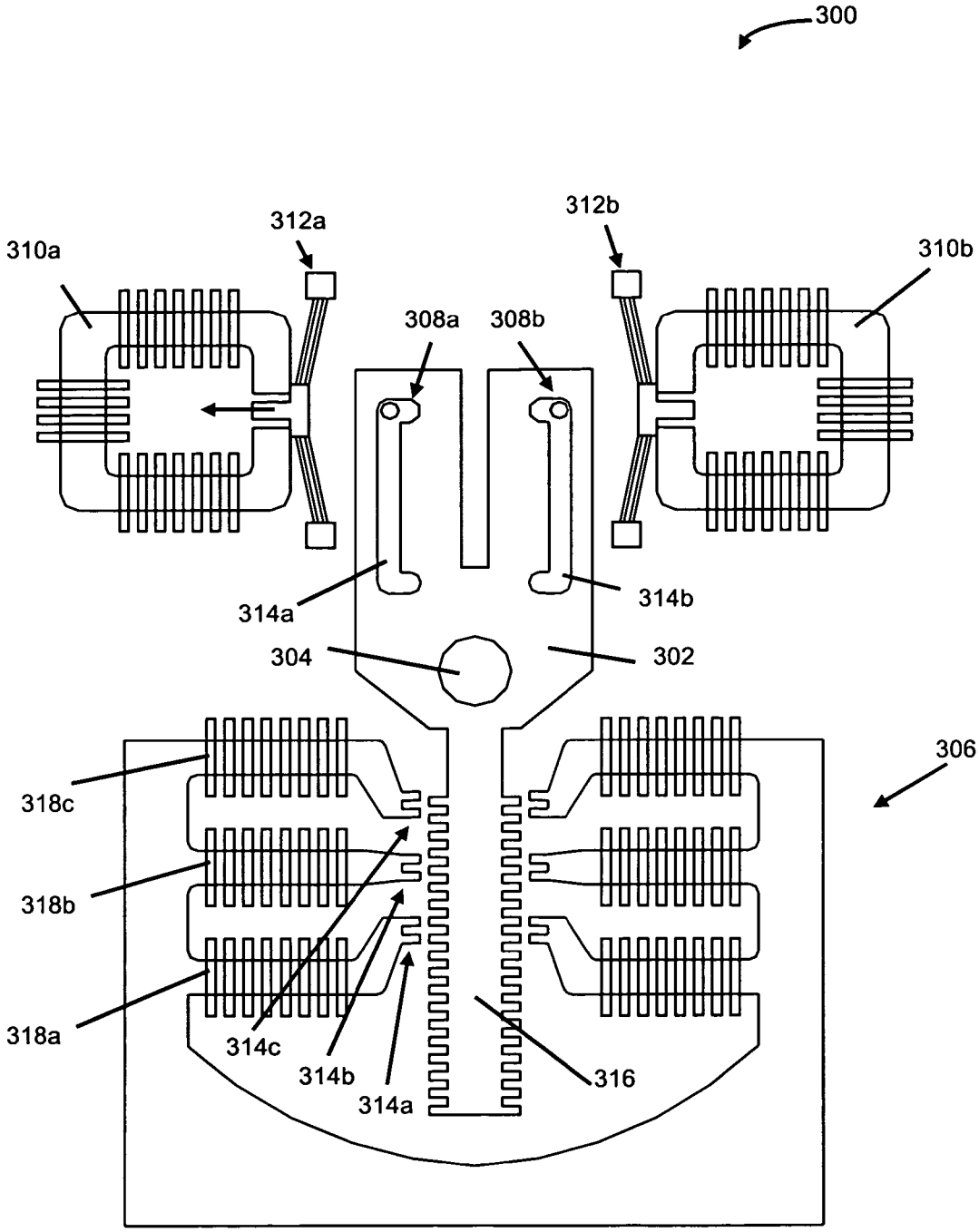

Likewise in FIG. 3C, a drive signal has been applied to actuator 310*a*, causing latching pin 308*a* to be disengaged from the interrupter 302, and into alignment with guide 314*a*. Activating the actuator 310*a* has caused the spring 312*a* to be loaded, such that removal of the drive signal would cause the latching pin 308*a* to re-engage the interrupter 302.

Figure 3D:
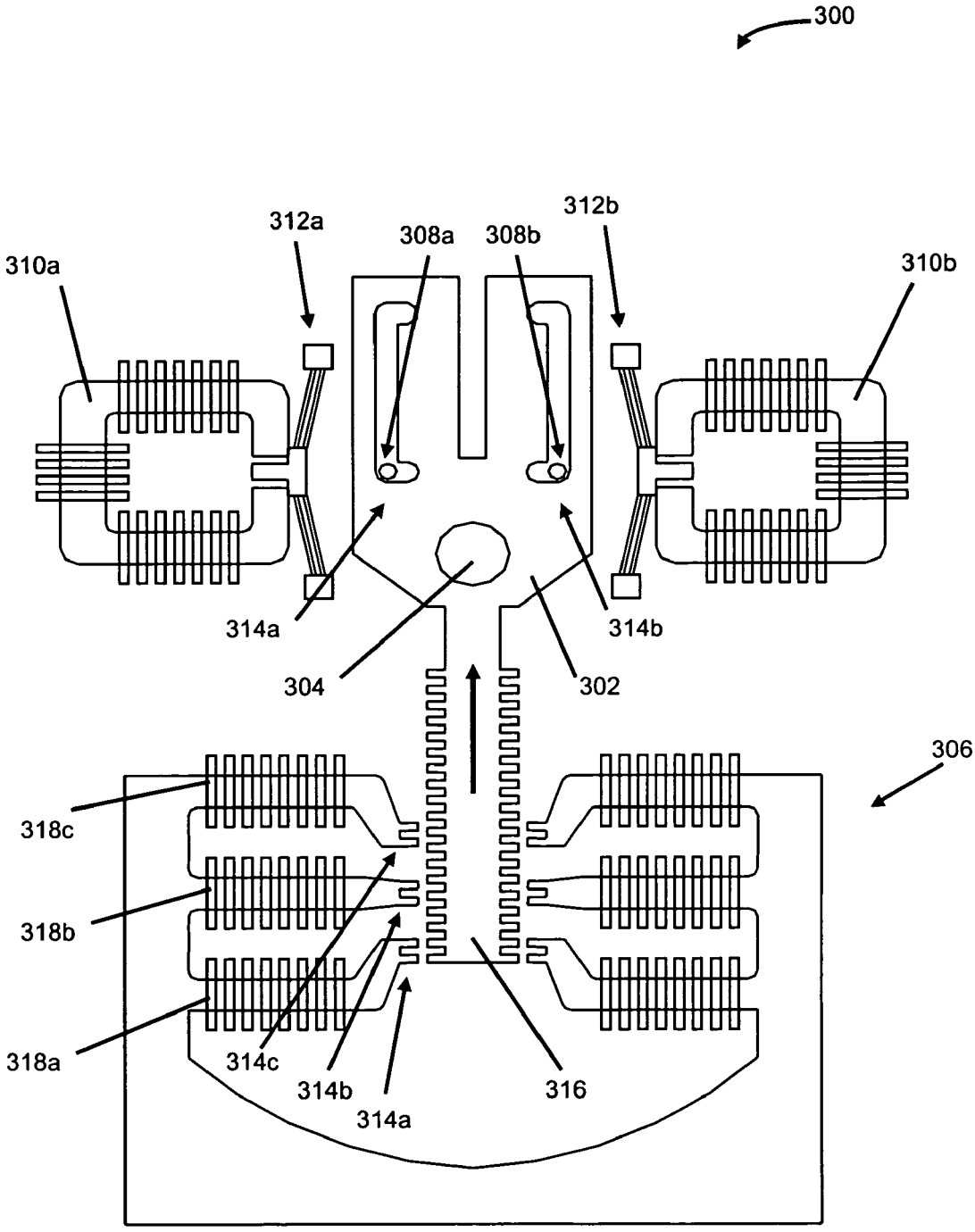

In FIG. 3D, with both latching pins disengaged from the interrupter, a drive signal has been applied to the variable reluctance motor 306, causing the interrupter 302 to move from an interrupted state, to an un-interrupted state, wherein aperture 304 is aligned to an explosive train (not shown). Latching pins 308*a-b* slide along guides 314*a-b* as the interrupter 302 moves between states. As illustrated in FIG. 3D, if the drive signals are removed from actuators 310*a-b*, latching pins 308*a-b* would be forced by the springs 312*a-b*, back into an engaged state with interrupter 302, thereby latching the interrupter in the uninterrupted state.

The variable reluctance motor 306 (e.g. a linear variable reluctance actuator) is illustrated as comprising three phases as exhibited by the three pairs of poles 314*a-c*, each pole piece comprising two teeth. For simplicity in the illustration, only the left half of each symmetrical pole pair 314*a-c* is indicated. Each pole pair 314*a-c* can be driven (e.g. actuated) independently by applying separate drive signals to the corresponding coils 318*a-c*. The teeth of the poles 314*a-c* are arranged with respect to the teeth of the traveler 316 so that at any given time, only the teeth of one of the pole pairs (e.g. pole pair 314*a* in the illustration) are aligned to corresponding teeth on the traveler 316. The teeth of the remaining pole pairs are offset by a distance of ⅓ (e.g. pole pair 314*b*) and ⅔ (e.g. pole pair 314*c*) of the spacing of the teeth on the traveler 316. In this arrangement, the traveler 316 and therefore the interrupter 302, will be actuated only when drive signals are applied to the coils 318*a-c*, in a proper sequence.

For the example as shown in FIG. 3D, to move the interrupter 302 from the uninterrupted state, in a direction downward in the illustration, drive signals would be applied to coils 318*a-c* in a repeating sequence as 318*b*, 318*c*, 318*a*, 318*b*, 318*c*, 318*a* . . . etc. Applying drive signals out of sequence will not allow the interrupter 302 to move and change state.

The use of actuators that are operated by differing drive signals, for the example in FIGS. 3A-D two AC and DC drive signals for operating solenoids 310*a-b*, and a three phase signal for operating the linear variable reluctance motor 306, add increasing levels of assurance that the state of the interrupter will not be changed unintentionally or inadvertently. In the example a three phase linear variable reluctance motor is illustrated, but a variable reluctance motor having more than three phases, or a rotary configuration could be used as well.

Figure 4:
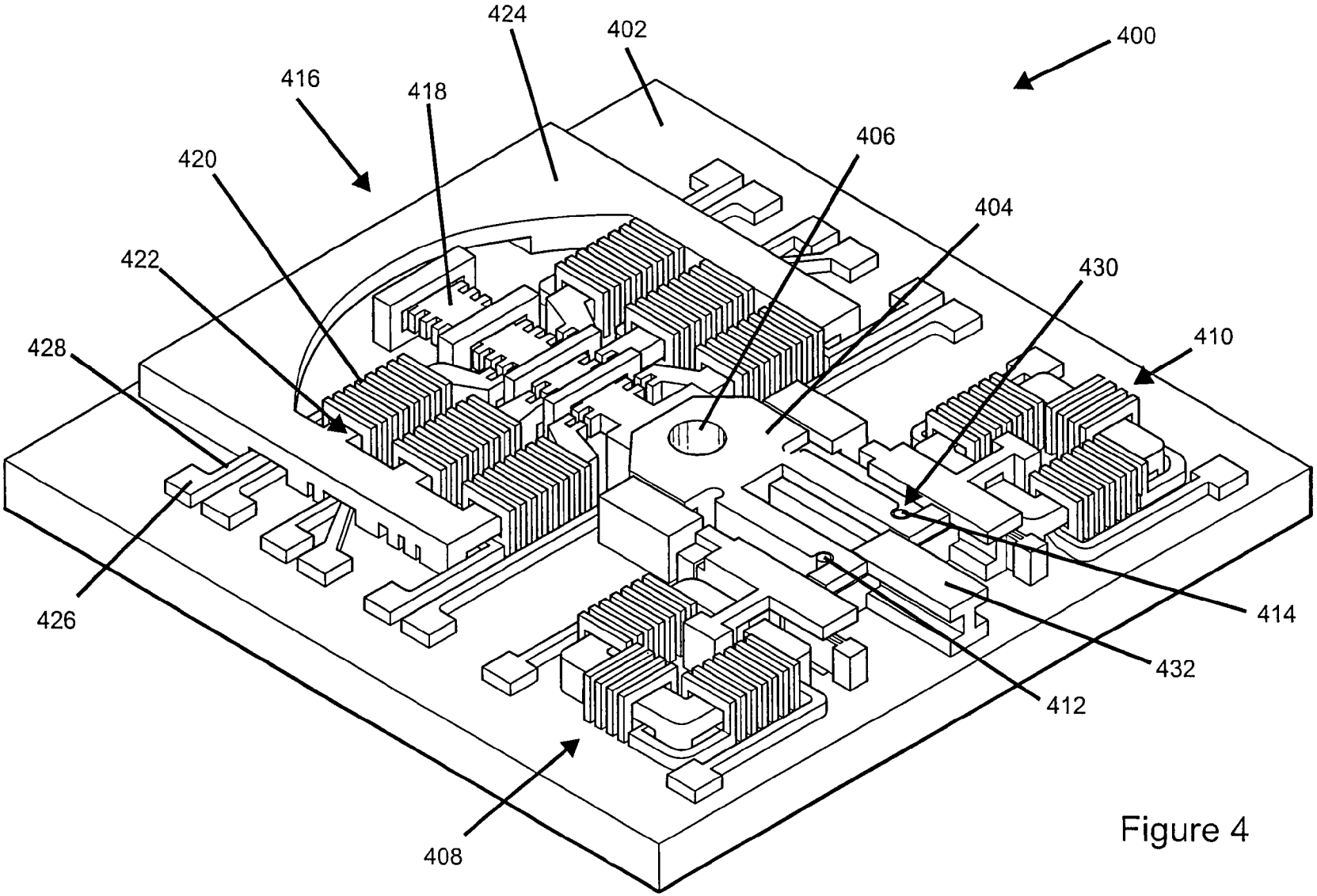
FIG. 4 is a perspective illustration of the embodiment shown in FIGS. 3A-3D.

FIG. 4 is a perspective illustration of an embodiment of a MEM safe arm device 400, as shown schematically in FIGS. 3A-D. MEM device 400 can be fabricated using commercially available MEM technologies, for example, as offered by Microfabrica INC, Van Nuys Calif., USA, wherein a repetitive process of electrodepositing and planarization of patterned sacrificial (e.g. copper) and structural (e.g. nickel and permalloy) metal layers, is used to create a desired three dimensional structure comprising a stack-up of patterned layers. The dimensions given are illustrative only, and do not represent limitations of the MEM safe arm device 400.

In this example, MEM safe arm device 400 is built up using eleven layers, deposited, patterned, and planarized, on a polished alumina substrate 402, having lateral dimensions of 6 mm on a side. Polished alumina substrates are available in a wide range of thicknesses (e.g. 0.25 mm to 1.28 mm), typically have on the order of 96% alumina content, and are available with surface finishes on the order of 1 μm. The thickness of each of the eleven layers, from the first layer deposited on the substrate up through the final layer are designed to be: 12, 3, 50, 50, 3, 50, 50, 50, 3, 50 and 50 μm respectively. The maximum thickness of a structural member, for example the thickness of the interrupter 404 (shown in the interrupted state) is 370 μm, and would comprise the "soft" magnetic material nickel (and nickel alloys). The diameter of the aperture 406 through the interrupter 404 is 500 μm. Other elements of the MEM safe and arm device 400 include electrical solenoid actuators 408 and 410, coupled to latching pins 412 and 414 respectively, and a three phase linear variable reluctance actuator 416 comprising a traveler 418, coupled to interrupter 404. In this design, the actuator 416 and traveler 418 are configured to slideably move the interrupter 404, a distance of approximately 1 mm along the axis of the traveler and interrupter (to the right as shown).

The teeth on traveler 418 are 50 μm wide and spaced 50 μm apart, as are the corresponding teeth on the pole pieces of the linear variable reluctance actuator 416. Coils on the actuators, for example 420, comprise 50 μm wide lines spaced 50 μm apart. Vertical gaps in the structure, for example at 422 to isolate the coil 420 from the armature 424 of the linear variable reluctance actuator 416, are 3 μm. Electrical pads, for example at 426, for interconnecting the MEM device 400 to external control electronics, are 250 μm on a side, and are connected to conductors, for example at 428, that are nominally 75 μm wide. Latching pins 412 and 414 are approximately 50 μm in diameter and are separated from interrupter 404 by a horizontal clearance gap 430 that can range from on the order of 10 μm to 50 μm. This same clearance gap is intended to be used between moving structures and their supporting guides, for example between the interrupter 404 and guide rail 432.

The entire structure of MEM safe arm device 400 can be constructed of nickel (and nickel iron alloy) layers deposited on substrate 402, while alternative embodiments can comprise using copper (and higher conductivity metals) for example, in electrical conductors, pads and coils, for example at 428, 426 and 420 respectively. A through hole, or second aperture (not shown) can be included in the substrate 402, aligned with aperture 406 when the interrupter is in the non-interrupting state, to provide a safe and arm capability for energetic components having an explosive train passing through the substrate of the MEM safe and arm device 400. Substrate 402 can additionally be provided with electrical vias through the thickness of the substrate, to accommodate back-side electrical interconnections.

As illustrated in FIG. 4, a complete and fully functional MEM device 400 can be realized as-fabricated, in an integrated form, without the need for attaching external elements to render the MEM safe and arm device 400 functional. For example, actuators 408, 410 and 416 are integrated, as-fabricated, with the interrupting member 404, and do not require additional assembly (e.g. attachment of coils or magnets) in a post MEM fabrication step, to render the device functional. In the context of the present disclosure, a MEM safe arm device wherein the actuators are integral, is defined to be a MEM safe arm device wherein the actuators are integrated and functional as-fabricated, and do not require additional assembly (e.g. attachment of coils or magnets) in a post MEM fabrication step, to render the device functional.

The above described exemplary embodiments present several variants of the invention but do not limit the scope of the invention. Those skilled in the art will appreciate that the present invention can be implemented in other equivalent ways. The actual scope of the invention is intended to be defined in the following claims.

What is claimed is:

1. A microelectromechanical (MEM) apparatus comprising:

a substrate;

an interrupting member slideably connected to the substrate, the interrupting member having an interrupted state and an uninterrupted state, wherein said interrupting member defining an aperture, wherein said interrupting member comprises an explosive train that includes an energetic material, a detonator, and an initiator;

at least one latching member slideably connected to the substrate, the at least one latching member having an engaged state and a disengaged state and, operatively arranged to engage the interrupting member in the engaged state, and disengage the interrupting member in the disengaged state; and, a first set of actuators for actuating the interrupting member and a second set of actuators for actuating the at least one latching member, said first set of actuators operatively connected to the substrate, whereby said second set of actuators causes the at least one latching member to be in the state selected from the group consisting of the engaged state and the disengaged state, and said first set of actuators causes the interrupting member to be in the state selected from the group consisting of the interrupted state, and the uninterrupted state, whereby the interrupting member is prevented from changing state, when the at least one latching member is in the engaged state.

2. The MEM apparatus of claim 1 wherein the first set of actuators is integral with the interrupting member and the at least one latching member.

3. The MEM apparatus of claim 1 wherein said first set of actuators comprises at least one actuator selected from the group consisting of an electrostatic actuator, an electromagnetic actuator, a piezoelectric actuator, a magnetostrictive actuator, and a thermal actuator.

4. The MEM apparatus of claim 3 wherein said at least one actuator comprises:

one or more solenoid actuators operatively connected to the at least one latching member; and, a variable reluctance actuator operatively connected to the interrupting member.

5. The MEM apparatus of claim 4 wherein the variable reluctance actuator comprises at least three phases.

6. The MEM apparatus of claim 1 further comprising at least one spring operatively connected to the at least one latching member.

7. The MEM apparatus of claim 6 wherein the at least one spring operates to cause a latching member in the at least one latching member to be in the engaged state or the disengaged state.

8. The MEM apparatus of claim 1 wherein the energetic material comprises one or more selected from the group consisting of silver azide, lead azide, copper azide, and lead styphnate.

9. The MEM apparatus of claim 1 wherein the initiator comprises one or more selected from the group consisting of a bridgewire, a slapper, a chip slapper, a reactive bridge, and a silicon bridgewire (SCB).

10. The MEM apparatus of claim 1 wherein the aperture is at least partially filled with the energetic material.

11. The MEM apparatus of claim 1 wherein at least one element of the explosive train is operatively arranged to be inline with another element within the explosive train, when the interrupting member is in the uninterrupted state.

12. The MEM apparatus of claim 1 wherein the substrate comprises one or more selected from the group consisting of a ceramic substrate, a glass filled ceramic substrate, a low temperature co-fired ceramic, a printed wiring board, a silicon wafer, a metal substrate, a dielectric coated metal substrate, and a dielectric coated silicon substrate.

13. A microelectromechanical (MEM) apparatus comprising:

an interrupting member having an interrupted state and an uninterrupted state;

a substrate to which the interrupting member is slideably connected, wherein the substrate comprises an element of an explosive train selected from the group consisting of a detonator, an initiator, and an aperture, wherein the element is disposed on a surface of the substrate and the element is substantially aligned to an aperture in the interrupting member, when the interrupting member is in the uninterrupted state;

at least one latching member slideably connected to the substrate, the at least one latching member having an engaged state and a disengaged state and, operatively arranged to engage the interrupting member in the engaged state, and disengage the interrupting member in the disengaged state; and, a first set of actuators for actuating the interrupting member and a second set of actuators for actuating the at least one latching member, said first set of actuators operatively connected to the substrate, whereby said second set of actuators causes the at least one latching member to be in the state selected from the group consisting of the engaged state and the disengaged state, and said first set of actuators causes the interrupting member to be in the state selected from the group consisting of the interrupted state, and the uninterrupted state, whereby the interrupting member is prevented from changing state, when at least one of the at least one latching member is in the engaged state.

14. The MEM apparatus of claim 13 wherein the first set of actuators is integral with the interrupting member and the at least one latching member.

15. The MEM apparatus of claim 13 wherein said first set of actuators comprises at least one actuator selected from the group consisting of an electrostatic actuator, an electromagnetic actuator, a piezoelectric actuator, a magnetostrictive actuator, and a thermal actuator.

16. The MEM apparatus of claim 15 wherein said at least one actuator comprises:

one or more solenoid actuators operatively connected to the at least one latching member; and, a variable reluctance actuator operatively connected to the interrupting member.

17. The MEM apparatus of claim 13 further comprising at least one spring operatively connected to the at least one latching member.

18. The MEM apparatus of claim 17 wherein the at least one spring operates to cause a latching member in the at least one latching member to be in the engaged state or the disengaged state.

19. The MEM apparatus of claim 13 wherein said interrupting member comprises one or more elements of an explosive train, selected from the group consisting of an energetic material, a detonator, an initiator, and an aperture.

20. The MEM apparatus of claim 19 wherein when the energetic material is selected, the energetic material comprises one or more selected from the group consisting of silver azide, lead azide, copper azide, and lead styphnate.

21. The MEM apparatus of claim 19 wherein when the initiator is selected, the initiator comprises one or more selected from the group consisting of a bridgewire, a slapper, a chip slapper, a reactive bridge, and a silicon bridgewire (SCB).

22. The MEM apparatus of claim 19 wherein when the aperture is selected, the aperture is at least partially filled with the energetic material.

23. The MEM apparatus of claim 19 wherein at least one element of the explosive train is operatively arranged to be inline with another element within the explosive train, when the interrupting member is in the uninterrupted state.

24. The MEM apparatus of claim 13 wherein the substrate comprises one or more selected from the group consisting of a ceramic substrate, a glass filled ceramic substrate, a low temperature co-fired ceramic, a printed wiring board, a silicon wafer, a metal substrate, a dielectric coated metal substrate, and a dielectric coated silicon substrate.

* * * * *